US008713760B2

(12) United States Patent
Krüdener et al.

(10) Patent No.: US 8,713,760 B2
(45) Date of Patent: May 6, 2014

(54) HINGE FOR A FURNITURE PART AND PIECE OF FURNITURE

(75) Inventors: Boris Krüdener, Darmstadt (DE); Mathias Rohner, Reinheim (DE)

(73) Assignee: Grass GmbH & Co. KG, Reinheim (DE)

( * ) Notice: Subject to any disclaimer, the term of this patent is extended or adjusted under 35 U.S.C. 154(b) by 0 days.

(21) Appl. No.: 13/565,060

(22) Filed: Aug. 2, 2012

(65) Prior Publication Data

US 2013/0019713 A1 Jan. 24, 2013

Related U.S. Application Data

(63) Continuation of application No. PCT/EP2011/000460, filed on Feb. 2, 2011.

(30) Foreign Application Priority Data

Feb. 3, 2010 (DE) ..... 10 2010 006 816

(51) Int. Cl.
*E05D 15/32* (2006.01)

(52) U.S. Cl.
USPC ..... 16/370

(58) Field of Classification Search
USPC ..... 16/54, 84, 86 C, 233, 365–366, 370, 16/DIG. 9, DIG. 10, 287, 288
See application file for complete search history.

(56) References Cited

U.S. PATENT DOCUMENTS

| | | | | |
|---|---|---|---|---|
| 4,590,641 | A * | 5/1986 | Lautenschlager et al. | 16/238 |
| 4,817,241 | A * | 4/1989 | Koch et al. | 16/238 |
| 4,914,782 | A * | 4/1990 | Rupprechter | 16/319 |
| 5,035,026 | A * | 7/1991 | Carlo et al. | 16/288 |
| 5,058,238 | A * | 10/1991 | Lautenschlager | 16/278 |
| 5,450,655 | A * | 9/1995 | Ferrari et al. | 16/370 |
| 6,243,918 | B1 * | 6/2001 | Zetti | 16/298 |
| 7,096,535 | B2 * | 8/2006 | Lin | 16/287 |
| 7,100,241 | B2 * | 9/2006 | Zetti | 16/304 |
| 7,406,749 | B2 * | 8/2008 | Herper | 16/368 |
| 7,574,775 | B2 * | 8/2009 | Zetti | 16/370 |
| 7,861,376 | B2 * | 1/2011 | Fitz et al. | 16/286 |
| 2007/0220705 | A1 * | 9/2007 | Fitz et al. | 16/54 |
| 2007/0251058 | A1 * | 11/2007 | Fitz et al. | 16/287 |
| 2008/0172834 | A1 * | 7/2008 | Sutterlutti | 16/286 |

FOREIGN PATENT DOCUMENTS

| | | | |
|---|---|---|---|
| AT | 005 477 | U1 | 7/2002 |
| EP | 1 555 372 | A1 | 7/2005 |
| GB | 1 484 294 | A1 | 9/1977 |
| WO | 2008/025592 | A1 | 3/2008 |

OTHER PUBLICATIONS

German Search Report dated Jul. 19, 2010.
International Search Report and Written Opinion dated Sep. 15, 2011.

* cited by examiner

*Primary Examiner* — Roberta Delisle
(74) *Attorney, Agent, or Firm* — Burr & Brown, PLLC

(57) ABSTRACT

A hinge for a movable furniture part fastened to a body of a piece of furniture is proposed, the hinge having a first fastening part which is attachable to the body and which is connected pivotably via a joint mechanism to a second fastening part attachable to the movable furniture part, the joint mechanism comprising articulated levers mounted via axes of articulation. According to the invention, a further pivotably mounted lever is present, which, during a complete as-intended pivoting movement of the hinge, is temporarily coupled to a guide portion on the hinge, the further lever acting upon a damper arrangement of the hinge.

12 Claims, 3 Drawing Sheets

HINGE FOR A FURNITURE PART AND PIECE OF FURNITURE

CROSS REFERENCE TO RELATED APPLICATIONS

This application is a continuation of International Application No. PCT/EP2011/000460 filed Feb. 2, 2011, which designated the United States, and claims the benefit under 35 USC §119(a)-(d) of German Application No. 10 2010 006 816.0 filed Feb. 3, 2010.

FIELD OF THE INVENTION

The invention relates to a hinge for a furniture part and piece of furniture.

BACKGROUND OF THE INVENTION

In the furniture sector, hinges for the pivotable mounting of furniture parts on a body are known. These hinges may comprise a fastening or hinge part attachable to the body and a hinge part fixable to the movable furniture part. By means of the fastening parts pivotable with respect to one another, furniture parts, such as, a door wing or a flap, can be moved via a joint mechanism provided by the hinge.

In what are known as double-link or four-joint hinges, for example, two articulated levers or articulated arms are present on the hinge.

SUMMARY OF THE INVENTION

The object of the present invention is to design abovementioned arrangements compactly with extended functionality. At the same time, a visually advantageous appearance of the hinge is to be implemented.

The invention proceeds from a hinge for a movable furniture part, in particular door or flap, fastened to a body of a piece of furniture, the hinge having a first fastening part which is attachable to the body and which is connected pivotably via a joint mechanism to a second fastening part attachable to the movable furniture part, the joint mechanism comprising articulated levers mounted via axes of articulation. A first essential aspect of the present invention is that a further pivotably mounted lever is present, which, during a complete as-intended pivoting movement of the hinge, is temporarily coupled to a guide portion on the hinge, the further lever acting upon a damper arrangement of the hinge. The damper arrangement of the hinge serves, in particular, during an as-intended pivoting movement of the hinge, to achieve a damped or braked movement into an end position of the pivoting action executed by the hinge. Consequently, when the hinge is in the state mounted on the piece of furniture, in particular, an undesirably violent slamming shut of the movable furniture part is avoided, in particular an unpleasant slamming-shut noise or damage to the furniture part and to the body.

The actuation of the damper arrangement takes place, in interaction of the further lever with the guide portion, advantageously always at the same point of the pivoting movement of the furniture part or in an always identical pivoting position of the hinge on the way into an end position of the pivoting movement which is possible by means of the hinge. The interaction of the further lever with the guide portion can be implemented in a highly space-saving way or compactly. In particular, the further lever and the guide portion may be provided in regions which are in any case free in known corresponding hinges. These regions preferably lie inside the hinge and are not visible or are scarcely visible from outside. Consequently, in the arrangement according to the present invention, a desired visual appearance or a preferred external design can be implemented without difficulty.

A further essential aspect of the present invention is that a further pivotably mounted lever is present, which, during a complete as-intended pivoting movement of the hinge, is temporarily coupled to a guide portion on the hinge, the further lever acting upon an actuator of the hinge. An actuator is to be understood, in general, as meaning an element which converts an input variable into an output variable of a different type in order to bring about a desired action or effect. Actuator principles which may be envisaged are, for example, inductively operating electric motors, hydraulic or pneumatic actuators, cylinders, electrochemical or electromechanical actuators or piezo-actuators.

In particular, an electric motor can be operated or activated via the interaction of the further lever with the guide portion.

By means of the actuator or electric motor, for example, a closing and/or opening movement of the movable furniture part can be influenced.

Also, for example, locking or latching of the movable furniture part via the actuator, in particular, in a closed end position via the actuator may be envisaged.

Basically, the possibility is not ruled out where a plurality of components, for example a damper arrangement and an actuator, can be acted upon via the interaction of the further lever with the guide portion.

Even two or more further levers having, in particular, in each case an assigned guide portion may be provided on a hinge.

By means of the hinge, when the hinge is in the installed state on the piece of furniture, a to-and-fro movement is predetermined in a kinematically defined way, the end positions of which are assigned to a completely closed and completely open position of the furniture part in relation to the body. The coupling of the further lever to the guide portion takes place at a specific point in the pivoting movement and the uncoupling of the further lever from the guide portion takes place during the subsequent return movement. During this interaction, starting from an end point, the further lever and the guide portion are put together after a specific fraction of the overall possible rotational or pivoting movement of the hinge. For example, as a result of the intermeshing of the two elements, their further movement then takes place together or in connection with one another. In this coupling state, the lever acts upon the damper arrangement or the actuator.

Intermeshing or coupling may take place, for example, with the aid of a capture or threading-in mechanism. For this purpose, the guide portion may have, for example, a slotted-link guide for the further lever. For this purpose, a portion of the further lever is exactly coordinated in its shape with the slotted-link guide.

The system may also be considered as a type of positive control of the further lever by the guide portion. The further lever remains unmoved in the non-coupled state and is pivoted in the coupling state.

It is also possible that movement of the guide portion and the further lever, even with respect to one another or contradirectionally, takes place until coupling occurs. During coupling, the movement of one of the two components may be stopped. In the coupled state, the overall system composed of the guide portion and of the further lever moves further on in a defined way, and resulting guidance in the guide portion may correspond to the instantaneous center of the movement of the further lever.

Preferably, the further lever is received pivotably via an axis separate from the axes of articulation. The further lever can thus be positioned variably or so as to be adapted to conditions of space. The further lever may be present, for example, on a fastening part in the region between two existing axes of articulation.

Moreover, it is advantageous that the further lever and the guide portion are coordinated with one another in such a way as to cancel a coupling state between the further lever and the guide portion which occurs during an as-intended pivoting movement of the hinge into an end position when the hinge executes a pivoting movement out of the end position. The coupling of the further lever to the guide portion and the maintenance of the coupling state take place via a part or a phase of the overall pivoting movement which is possible by means of the hinge. This phase describes, in particular, a phase before an end point of the pivoting movement is reached, that is to say the coupling point up to the associated end point, without any reversal in direction of movement. Out of this end position, with the direction of movement reversed, the coupling state is maintained until the corresponding coupling point is reached and uncoupling or decoupling takes place. Uncoupling is usually maintained until the other end point is reached. However, further coupling during the pivoting movement into the other end point is not ruled out.

In the situation mounted on the piece of furniture, during a return movement of the hinge, for example when the movable furniture part is being opened in relation to the body, a decoupled or non-coupled situation of the further lever and of the guide portion is resumed. In this case, the damper arrangement or actuator is brought again into an initial state correspondingly before being acted upon by the lever. During the subsequent renewed closing movement, the damper arrangement or actuator of the hinge is then operated once again.

It is proposed, further, that the further lever be designed to act upon a portion of a component which is present on the first fastening part attachable to the body. Thus, the damper or actuator can be accommodated on the fastening part attached to the body, this usually being advantageous for structural reasons or for reasons of space.

Basically, however, the situation is not ruled out where the damper arrangement or actuator is present on the fastening part which is received on the body.

Advantageously, the guide portion is received between two axes of articulation of the hinge. The guide portion may, in particular, be present advantageously between an axis of articulation fixed in position on a fastening part and an axis of articulation co-moved during the pivoting action. Thus, the guide portion can be accommodated in an especially space-saving way.

Preferably, the guide portion comprises a guide groove which is designed to be coordinated for temporary coupling to a meshing portion of the further lever. For example, a projecting or raised part, such as a meshing nose on the further lever, can engage into the guide groove and, if appropriate, in the coupling state, be moved along the guide groove. A reversal in shape is not ruled out, whereby the guide portion has a meshing portion which in the coupling state engages into a guide groove on the further lever.

It is advantageous, further, that the guide portion is present in such a way that the guide portion is co-moved during an as-intended pivoting movement of the hinge. In particular, the guide portion moves whenever the pivoting movement takes place. Thus, the guide portion may be provided, for example, on an articulated lever, for example in one piece with the latter or as an additional part on it.

Furthermore, it is advantageous that the further lever is mounted pivotably on one of the fastening parts. In particular, the further lever is designed as a two-armed lever. Thus, the further lever can interact at one end with the guide portion and at the other end with the damper arrangement or actuator. The further lever may have a kink or bend, particularly in the region of its axis, as seen in the longitudinal direction.

It is proposed, further, that the further lever and the damper arrangement be arranged on the same fastening part. Thus, action upon the damper by the lever can take place in the immediate vicinity. The further lever and the actuator can correspondingly be arranged on the same fastening part.

Furthermore, it is preferable that the hinge is designed as a universal joint hinge. In concrete terms, the universal joint hinge can be designed to be especially stable and for different maximum bridgeable angular ranges of the pivoting movement. The joint mechanism of a universal joint hinge may comprise, in particular, a first and a second universal joint lever and a first and second connecting lever, the first connecting lever being connected via a first joint to the first fastening part and via a second joint to the first universal joint lever which is received on the second fastening part via a third fastening-side universal lever joint, and the second connecting lever being connected via a fourth joint on the second fastening part and via a fifth joint to the second universal joint lever which is received on the first fastening part via a sixth fastening-side universal lever joint, and the two universal joint levers being connected to one another in an articulated way via a universal joint. During the movement of articulation, all the levers can be pivoted simultaneously in each case about an assigned joint of the joints mentioned.

It is preferable in this case that the guide portion is provided between the universal joint and a fastening-side universal lever joint and, during a pivoting movement capable of being executed by means of the hinge, can be co-moved according to the movement of one of the two universal joint levers.

In an advantageous modification of the subject of the invention, the hinge is designed as a wide-angle hinge. A wide-angle hinge makes it possible, in the state of use, to have an especially wide opening or pivoting of the movable furniture part in relation to a closed position on the body. Thus, in particular, even greater pivoting angles up to and exceeding 160 degrees of angle can be implemented.

The invention relates, moreover, to a piece of furniture having a movable furniture part, in particular door or flap, fastened to a body of the piece of furniture, the piece of furniture having a hinge according to one of the abovementioned versions. The advantages already explained above can consequently be implemented on the piece of furniture.

BRIEF DESCRIPTION OF THE DRAWINGS

Further features and advantages of the invention are explained by means of a hinge according to the invention illustrated in the figures.

DETAILED DESCRIPTION OF THE INVENTION

Figure 1:
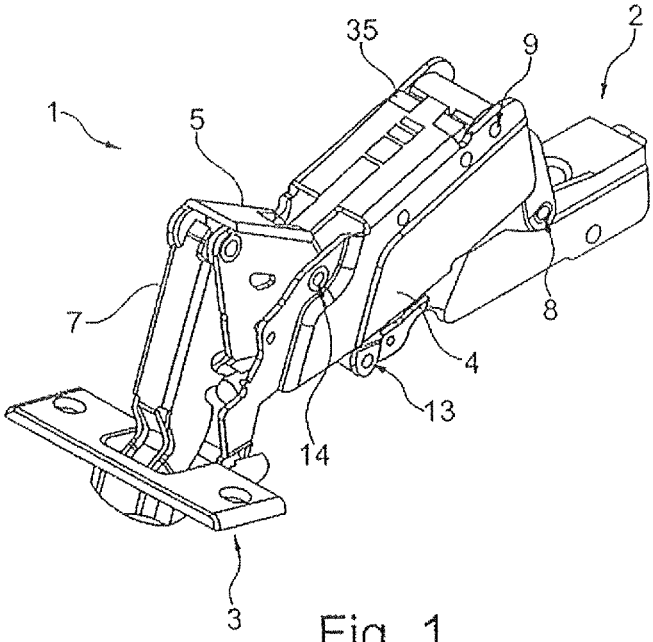
FIG. 1 shows a perspective view of a hinge according to the invention in an intermediate position of a pivoting movement executable by means of the hinge.

The hinge 1 according to the present invention, shown in the figures, is designed as what is known as a wide-angle or universal joint hinge. The hinge 1 comprises a body hinge part 2, which is attachable to a body K of a furniture part, and a door wing fastening part or hinge pot or movable furniture part hinge part 3 which is attachable to a furniture part M, such as, for example, a door wing or flap, received movably on the body via the hinge 1. The body K and the furniture part M are indicated purely diagrammatically in the form of a detail in FIG. 3*a*. The hinge parts 2 and 3 can be secured in each case on the inside respectively to the body and to the movable furniture part, in particular, via screws or via quick-action securing means, in particular without a tool. The two hinge parts 2 and 3 are connected to one another pivotably with respect to one another via a joint mechanism by means of four articulated arms 4 to 7. The articulated arms comprise a first cross arm 4 and a second cross arm 5 and also a first connecting arm 6 and a second connecting arm 7. In this case, the joint mechanism has seven pivot joints 8 to 14 which are designated below as the first to the sixth joint and as a universal joint. The first joint 8 serves for the pivotable reception of the first connecting arm 6 on the body hinge part 2, the connecting arm 6 being connected via a second joint 9 to the first cross arm 4 which is received in turn on the furniture part hinge part 3 in an articulated manner via a third joint 10. Moreover, the second connecting arm 7 is received in an articulated manner on the furniture part hinge part 3 via a fourth joint 11 and is connected in an articulated manner to the second cross arm 5 via a fifth joint 12. Moreover, the second cross arm 5 is received on the body hinge part 2 in an articulated manner via a sixth joint 13. Furthermore, the two cross arms 4, 5 are connected to one another in an articulated manner via a universal joint 14. All the axes of articulation of the joints 8 to 14 are parallel or perpendicular to the sectional plane of FIGS. 3*a* and 4*a*.

Figure 2:
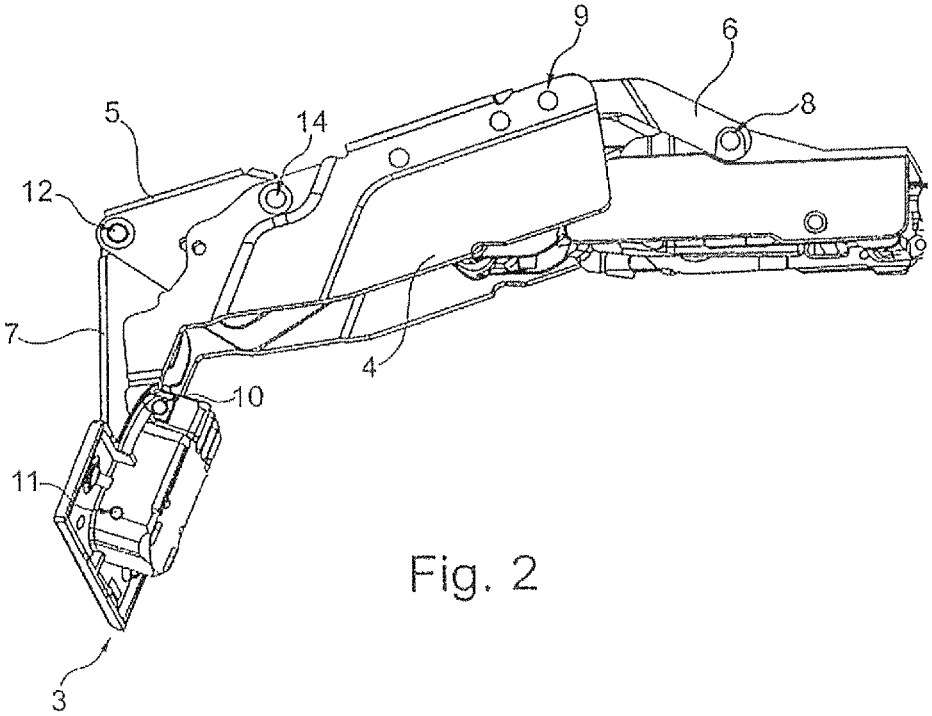
FIG. 2 shows a further perspective view of the hinge according to FIG. 1 in an end position.
Figure 4B:
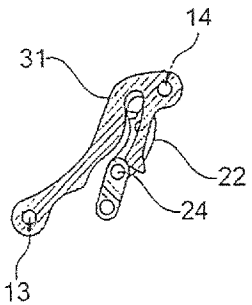
FIG. 4*b* shows two components of the arrangement according to FIG. 4*a*, viewed individually.
Figure 4A:
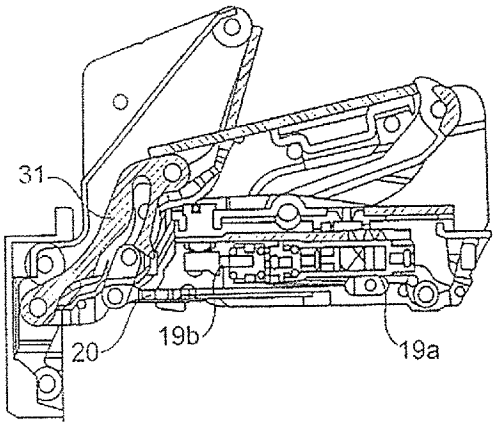
FIG. 4*a* shows the hinge according to FIGS. 1 to 3*a* in a section in the longitudinal direction in a further end position to the end position according to FIG. 2.

In the state mounted on the piece of furniture, the movable furniture part M can consequently be brought via the joint mechanism provided by the hinge 1 out of its position closed with respect to the body K or the end position of the hinge 1 according to FIG. 4*a* into a maximum widely pivoted open position of the furniture part or into the end position of the hinge 1 according to FIG. 2, this corresponding to a maximum pivot angle of more than 160 degrees of angle. The hinge 1 is therefore also designated as a wide-angle hinge.

Figure 5:
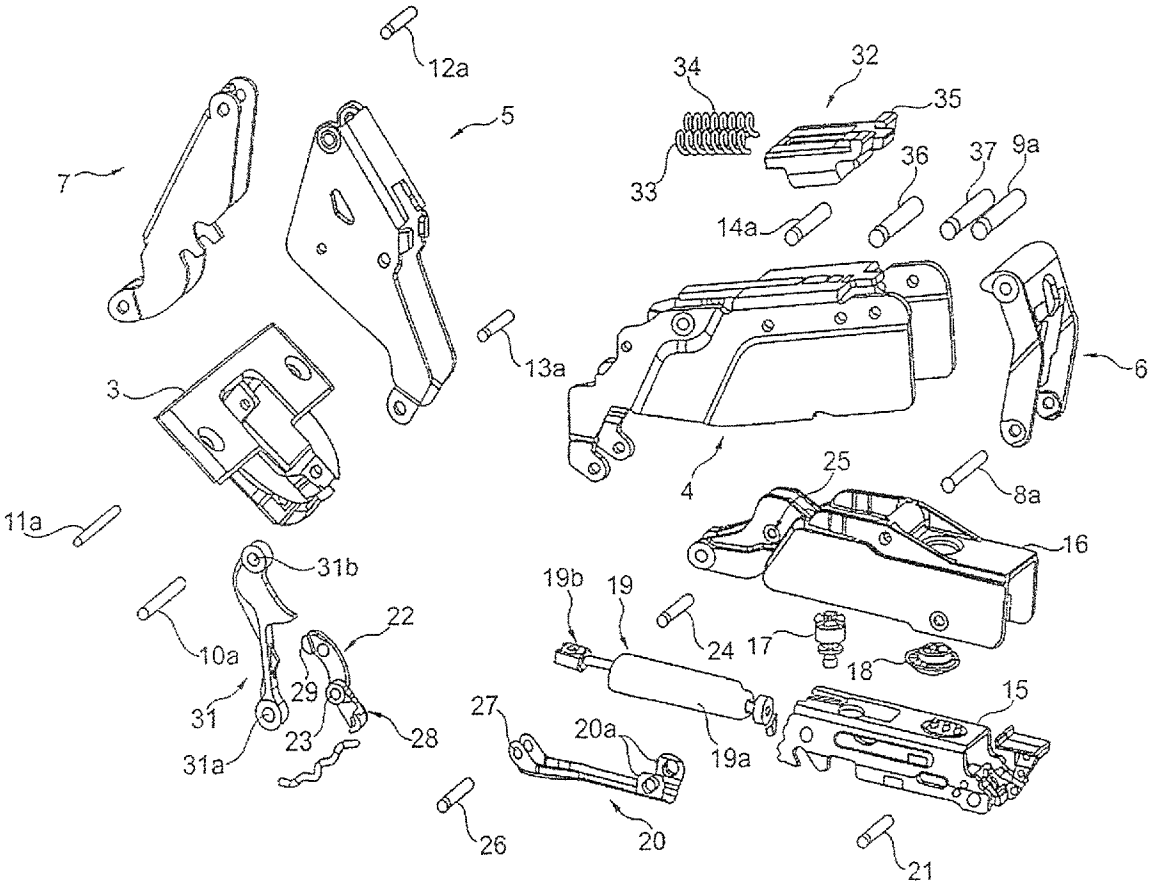
FIG. 5 shows an exploded illustration of the hinge in the intermediate position according to FIG. 1.

As may be gathered from FIG. 5, the joints 8 to 14 are implemented for their articulated functioning in each case with an axle pin 8*a* to 14*a* which are received in correspondingly fitting orifices or bores in the components connected to one another.

Furthermore, it is clear from FIG. 5 that the body hinge part 2 comprises an inner mounting part 15 and a place-on part 16 capable of being placed onto or over the latter. Moreover, the body hinge part 2 comprises, for setting the mounted hinge 1, adjustment means which comprise setscrew 17 and an adjusting element 18. Moreover, the mounting part 15 has integrated in it a separately insertable damper 19, designed, for example, as a fluid damper, of a damper arrangement, the damper characteristic of which can be set or adjusted. The damper 19 comprises a housing 19*a* which receives displaceably a piston, not shown, to which a piston rod 19*b* projecting out of the housing 19*a* is connected. An operating handle 20 is connected to the housing 19*a* on the outside via clamping jaws 20*a*. The piston rod 19*b* is connected to the lower end of the setscrew 17.

A connecting pin 21 serves for the connection of the mounting part 15 and of the place-on part 16.

For directed action upon the damper 19, a control is provided, which comprises an operating lever 22 which is connected to the housing 19*a* and which is mounted pivotably on the place-on part 16 via a bore 23 in the operating lever 22, a bore 25 in the place-on part 16 and an axle pin 24 passing through the bores 23 and 25, with a pivot axis which runs parallel to the axes of articulation 8 to 14. To couple the pivoting movement of the operating lever 22 to the translational movement of the housing 19*a*, the operating lever 22 is designed as a two-armed lever. The operating lever 22 is connected in an articulating manner, at its end facing the place-on part 16, via an axle pin 26 to the operating handle 20 via a further bore 28 on the end face on the operating lever 22 and a bore 27 in the operating handle 20. At the end facing away from the place-on part 16, the operating lever 22 is provided with a meshing portion in the form of profiling, in the form of a nose 29 which projects laterally to the longitudinal extent and which temporarily or in-phase interacts or is coupleable and uncoupleable with respect to a guide portion 30 on a guide lever 31.

Figure 3B:
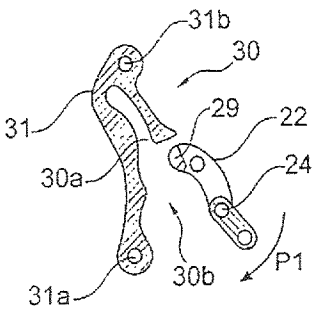
FIG. 3*b* shows two components of the arrangement according to FIG. 3*a*, viewed individually.

The guide portion 30 in the guide lever 31 comprises a slightly curvedly running groove 30*a*, as can be seen particularly according to FIGS. 3*b* and 4*b* in the middle longitudinal section through the guide lever 31, with a groove depth which corresponds approximately to the height of the projecting nose 29. The groove 30*a* terminates, closed, in the guide lever 31, and, for coupling and uncoupling the nose 29 with respect to the guide portion 30 reliably and smoothly, the groove 30*a* widens at its open end via a widening or laterally funnel-shaped threading-in portion 30*b*. The nose has correspondingly, for exact unthreading and threading in or sliding in the groove 30*a*, in section a configuration half-sidedly convex and half-sidedly flat.

Instead of the guide groove, a long hole open on the end face, an indentation, a slotted-link guide, etc. may be formed.

The guide lever 31 has in the end in each case bores 31*a*, 31*b*, via which the guide lever 31 is tension-mounted between the axle pins 13*a* and 14*a* or the corresponding joints 13 and 14. Consequently, the guide lever 31 is co-moved correspondingly with that part of the second cross arm 5 which is moved during the pivoting action by means of the hinge 1. This also becomes clear from FIGS. 3*a* and 4*a*, according to which the guide lever 31, in FIG. 3*a*, stands, correspondingly to the intermediate position shown, with its longitudinal orientation approximately perpendicular to the longitudinal extent of the body hinge part 2 and, in FIG. 4*a*, is inclined about 45 degrees of angle to the right by means of the hinge 1 in an end position of the pivoting mechanism. These positions correspond to the respectively associated pivoting positions of the second cross arm 5.

Basically, the guide portion or the guide lever 31 and the further lever or the actuating lever 22 can be present elsewhere in the hinge 1 or in other hinges.

Moreover, the hinge 1 has, integrated in the first cross arm 4, a draw-in arrangement 32 which, on a last portion of the pivoting movement before a closing position according to FIG. 4*a* is reached, automatically presses or draws the hinge 1 into the closed end position according to FIG. 4*a* via two integrated helical springs 33, 34 and a pressure plate 35 when a predeterminable pivoting position of said hinge is reached, the closing force necessary for this purpose being implemented by the two prestressed helical springs 33, 34. In this case, after blocking of the draw-in arrangement 32 is cancelled, this taking place, for example, during the closing of a furniture part M on a body K by means of the hinge 1 at a predeterminable pivot point, the helical springs 33, 34 act upon the pressure plate 35 such that the latter is displaced in the direction of the connecting arm 6, so that damped closing of the furniture part M into the end position according to FIG. 4*a* occurs. Shortly after the draw-in arrangement 32 has been activated, during the further closing movement the damper arrangement 19 is subsequently likewise activated by the coupling of the actuating lever 22, on the one hand, to the guide lever 31 and, on the other hand, to the operating handle 20.

The draw-in arrangement 32 is held on the cross arm 4 via two cotter pins 36, 37.

During the renewed opening of the movable furniture part M attached to the furniture part hinge part 3 in relation to the body K, the draw-in arrangement 32 is brought again into its prestressed position (FIGS. 1, 2, 3*a*) and held in this, until, during a return movement by the pivoting of the hinge 1 as the respective furniture part is being closed, the predetermined draw-in position is resumed. Correspondingly, the damper arrangement 19 is brought into the position of readiness according to FIGS. 1, 2 and 3*a* again by the housing 19*a* being pushed back into the position of readiness as a result of the action of the actuating lever 22 which pivots back correspondingly during the opening of the furniture part M.

Thus, when the furniture part M is being closed, during the pivoting action no shock-like bumping of the furniture part M against the body K can take place in spite of the automatic draw-in mechanism or slamming shut. When the closing movement is being damped, the housing 19*a* is moved in the direction of a front end of the piston rod 19*b* projecting out of the housing 19*a* and held in a fixed position. This movement takes place in a damped or braked manner.

Figure 3A:
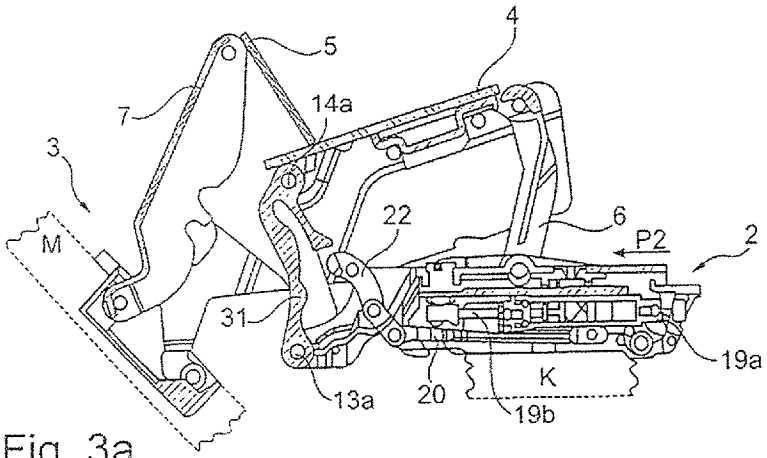
FIG. 3*a* shows a side view of the arrangement according to FIG. 1 in a section in the longitudinal direction of the hinge.

During the damping action, the operating lever 22 is pivoted clockwise according to the arrow P1 in FIG. 3*b* about the axle pin 24 in the bore 25, so that the housing 19*a* is displaced in relation to the free end of the piston rod 19*b* according to the arrow P2 in FIG. 3*a*. During coupling, the nose 29 at the front of the operating lever 22 in the guide portion 30 is brought into the end position according to FIGS. 4*a* and 4*b*. During renewed opening or pivoting in the opposite direction, the damper housing 19*a* is pushed back again into the position of readiness shown according to FIG. 3*a* as a result of the interaction of the guide lever 31 and of the operating lever 22.

LIST OF REFERENCE SYMBOLS

1 Hinge
2 Body hinge part
3 Furniture part hinge part
4 Cross arm
5 Cross arm
6 Connecting arm
7 Connecting arm
8 to 13 Joint
8*a* to 14*a* Axle pin
14 Universal joint
15 Mounting part
16 Place-on part
17 Setscrew
18 Adjusting element
19 Damper
19*a* Housing
19*b* Piston rod
20 Operating handle
20*a* Clamping jaw
21 Connecting pin
22 Operating lever
23 Bore
24 Axle pin
25 Bore
26 Axle pin
27 Bore
28 Bore
29 Nose
30 Guide portion
30*a* Groove
30*b* Threading-in portion
31 Guide lever
31*a*, 31*b* Bore
32 Draw-in arrangement
33, 34 Helical spring
35 Pressure plate
36, 37 Cotter pin

The invention claimed is:

1. A hinge for a movable furniture part, in particular door or flap, fastened to a body of a piece of furniture, the hinge having a first fastening part which is attachable to the body and which is connected pivotably via a joint mechanism to a second fastening part attachable to the movable furniture part, the joint mechanism comprising articulated levers mounted via axes of articulation, and a further pivotably mounted lever being present, which, during a complete as-intended pivoting movement of the hinge is temporarily coupled to a guide portion on the hinge, the further lever acting upon a damper arrangement of the hinge, wherein the further lever is received pivotably via an axis separate from the axes of articulation.

2. The hinge as claimed in claim 1, wherein the damper is selected from the group consisting of an inductively operating electric motor, as a hydraulic or pneumatic actuator, as a cylinder, as an electrochemical or electromechanical actuator, and as a piezo-actuator.

3. The hinge as claimed in claim 1, wherein the further lever and the guide portion are coordinated with one another in such a way as to cancel a coupling state between the further lever and the guide portion, the coupling state occurring during an as-intended pivoting movement of the hinge into a first pivoting direction at a coupling point of the pivoting movement, during a pivoting movement of the hinge out of the coupling point into a second pivoting direction which is opposite to the first pivoting direction.

4. The hinge as claimed in claim 1, wherein the further lever is designed to act upon a portion of a component which is present on the first fastening part attachable to the body.

5. The hinge as claimed in claim 1, wherein the guide portion is received between two axes of articulation of the hinge.

6. The hinge as claimed in claim 1, wherein the guide portion comprises a guide groove which is designed to be coordinated for temporary coupling to a meshing portion of the further lever.

7. The hinge as claimed in claim 1, wherein the guide portion is present in such a way that the guide portion is co-moved during an as-intended pivoting movement of the hinge.

8. The hinge as claimed in claim 1, wherein the further lever is mounted pivotably on one of the fastening parts.

9. The hinge as claimed in claim 1, wherein the further lever and the damper arrangement are arranged on the same fastening part.

10. The hinge as claimed in claim 1, wherein the hinge is designed as a universal joint hinge.

11. The hinge as claimed in claim 1, wherein the hinge is designed as a wide-angle hinge.

12. A piece of furniture having a movable furniture part, in particular door or flap, fastened to a body of the piece of furniture, the piece of furniture having a hinge as claimed in claim 1.

* * * * *